US007318429B2

(12) United States Patent
Achkar

(10) Patent No.: US 7,318,429 B2
(45) Date of Patent: Jan. 15, 2008

(54) UTILITY TOOL DEVICE FOR AN ARCHERY BOW

(76) Inventor: Nibal Achkar, P.O. Box 1420, Biggar, Saskatchewan (CA) S0K 0M0

( * ) Notice: Subject to any disclaimer, the term of this patent is extended or adjusted under 35 U.S.C. 154(b) by 10 days.

(21) Appl. No.: 11/027,126

(22) Filed: Dec. 31, 2004

(65) Prior Publication Data

US 2006/0144382 A1 Jul. 6, 2006

(51) Int. Cl.
*F41B 5/00* (2006.01)

(52) U.S. Cl. ..... 124/86; 124/88

(58) Field of Classification Search ..... 124/23.1, 124/25.6, 86, 88; 206/376, 377; 224/916
See application file for complete search history.

(56) References Cited

U.S. PATENT DOCUMENTS 2,119,217 A * 5/1938 Rocchi ..... 206/376
3,840,944 A * 10/1974 Gresley ..... 248/225.11
4,907,567 A * 3/1990 Henrich ..... 124/89
5,511,662 A * 4/1996 Amoroso et al. ..... 206/373
5,918,741 A * 7/1999 Vasudeva ..... 206/376
5,938,028 A * 8/1999 Hu ..... 206/377
6,191,574 B1 * 2/2001 Dilger ..... 324/178
6,612,299 B2 * 9/2003 Martin et al. ..... 124/86
6,637,122 B2 * 10/2003 Henry ..... 33/506
6,745,756 B1 6/2004 Achkar
6,902,089 B2 * 6/2005 Carnevali ..... 224/553

* cited by examiner

*Primary Examiner*—John A. Ricci
(74) *Attorney, Agent, or Firm*—D. Peter Hochberg; Sean F. Mellino

(57) ABSTRACT

A utility tool device for an archery bow. The device comprises one or more tools which are commonly used by archers for the proper maintenance, repair and operation of a bow. These tools include: a nock wrench, one or more Allen wrenches, a broadhead wrench, a shot counter and a sharpener. The device can be incorporated directly into the riser of a bow or attached to the bow riser in areas which will not interfere with the operation of the bow.

11 Claims, 3 Drawing Sheets

UTILITY TOOL DEVICE FOR AN ARCHERY BOW

FIELD OF THE INVENTION

The present invention relates to a utility tool device for an archery bow which can be attached to a bow or incorporated directly into the riser of a bow.

BACKGROUND OF THE INVENTION

A wide variety of utility tools are required for the proper maintenance, repair and operation of an archery bow and its related accessories. Some of the more commonly used tools or implements are nock wrenches, broadhead wrenches, broadhead sharpeners and various types of Allen wrenches. These tools are generally stored in a toolbox and taken out when required. On occasion, such items may also be carried by an archer or transported in his or her pocket, since it is not always practical to carry a toolbox.

These methods of storage and transportation are somewhat undesirable from an archer's perspective, as it can be cumbersome for an archer to transport a toolbox along with his or her bow and inconvenient to carry such items around by hand or store them in a pocket. Hand and pocket storage can often lead to tools being misplaced, lost or forgotten.

In situations where it is not practical or desirable for an archer to carry a toolbox, or where tools have been forgotten or misplaced, it is not uncommon for archers to attempt to make certain adjustments manually, without any tools. Sometimes this can be a safety concern. For example, when hunting, an archer typically uses a broadhead, which consists of several razor sharp blades. The broadhead must be secured and tightened onto an arrow and this is normally accomplished with a broadhead wrench. However, in circumstances where such a wrench is not readily available, an archer may attempt to tighten the broadhead manually, which can sometimes result in the archer being cut or scraped unnecessarily. In addition to causing injury to an archer, attempts to manually adjust certain parts of a bow can also result in damage to the bow itself, since some components are not particularly strong or durable and are prone to damage if care is not taken.

Not all archery tools and implements are sold individually. Some are incorporated into accessories that can be secured to a bow. An example of such an accessory is taught in U.S. Pat. No. 6,745,756 to Achkar, which discloses a bow carrying and support structure which can be adapted to include a broadhead wrench, a sling or an arrow rest. Although somewhat more convenient, not all archers prefer to have a bow carrying and support structure attached to their bow. Moreover, such accessories are generally not equipped to include many of the different types of utility tools that are required for proper maintenance and operation of the bow.

SUMMARY OF THE INVENTION

Accordingly, it is an object of the present invention to provide a utility tool device for an archery bow that contains one or more of the tools which are necessary for the proper operation, set-up, repair and/or maintenance of an archery bow. It is a further object of the present invention to provide a utility tool device which permits an archer to carry and store one or more archery tools in a convenient and less cumbersome manner.

These and other objectives are accomplished by providing an archery bow incorporating a utility tool device consisting of a body for carrying or supporting one or more tools, and one or more tools selected from a sharpener, a shot counter, a broadhead wrench and a nock wrench. The tools are associated with the body and the body is formed as an integral component of a riser on the bow in an area where it will not interfere with the operation of the bow. The device may also optionally include one or more Allen wrenches.

A further embodiment consists of a utility tool device for an archery bow, consisting of a body for carrying or supporting two or more tools selected from a sharpener, a counter, a broadhead wrench, a nock wrench; and one or more individual Allen wrenches, as well as a means for securely but releasably attaching the body to a portion of the riser or any other part of the bow, where it will not interfere with the operation of the bow.

Figure 1:
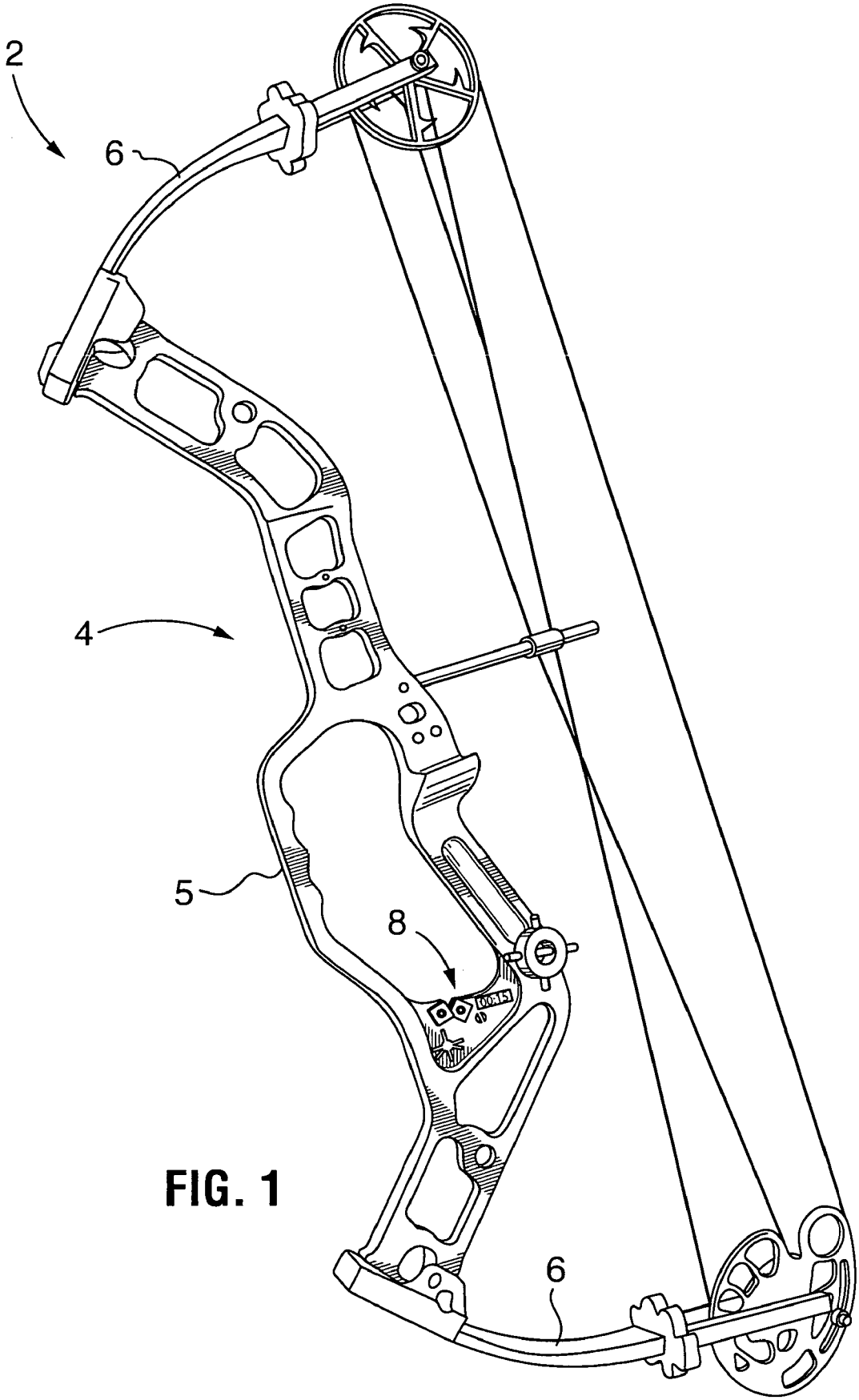
FIG. 1 is a side view of an archery bow incorporating the utility tool device according to the present invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE DRAWINGS

In the following description, similar features in the drawings have been given similar reference numerals.

Figure 2:
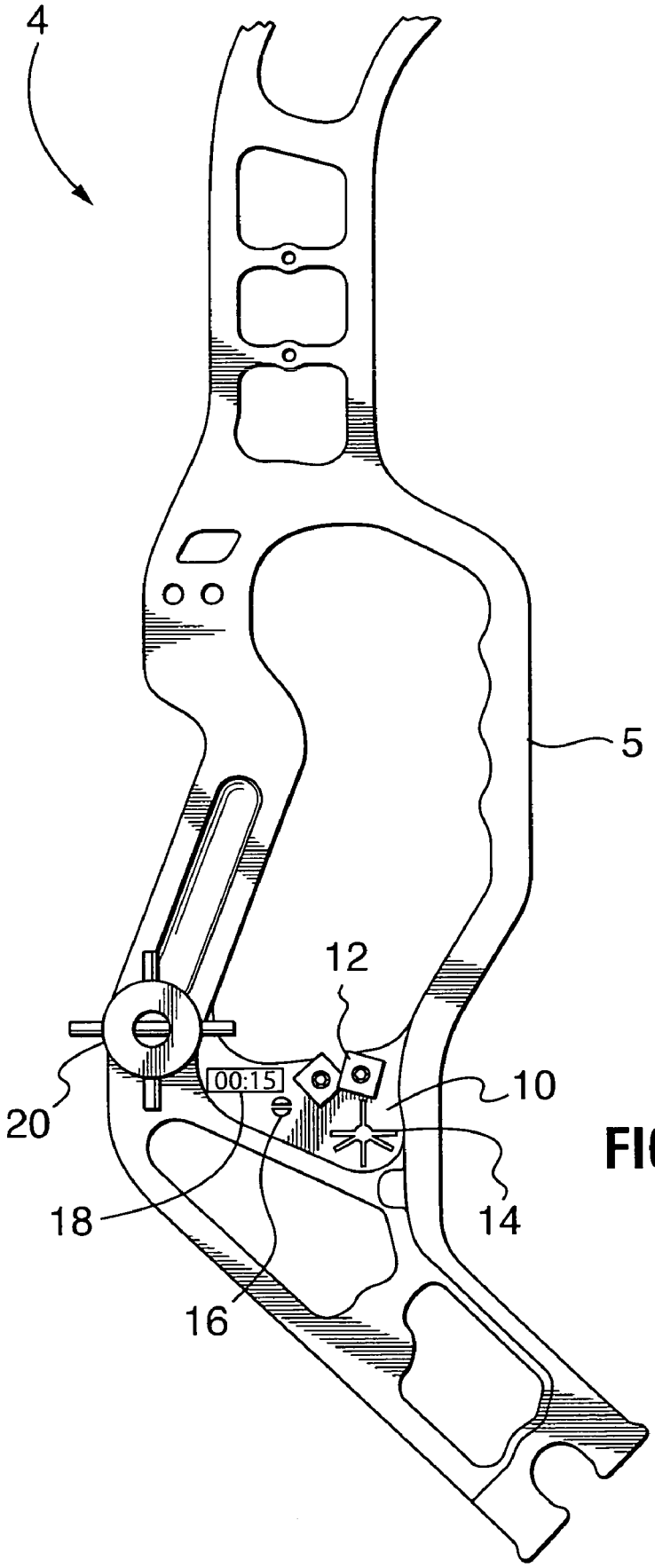
FIG. 2 is an enlarged partial side view of the riser of the bow of FIG. 1, incorporating the utility tool device of FIG. 1.

Turning to FIG. 1, there is illustrated a conventional archery bow 2 having a riser 4, integral carrying handle 5, and limbs 6 positioned on either side of the riser. The utility tool device 8 according to the present invention is shown incorporated into the riser of the bow. As shown in FIG. 2, the device consists of a tool supporting body 10 and one or more of the tools which are commonly used by archers to properly maintain, repair and operate their bow. In particular, the device may include a sharpener 12, a nock wrench 16, a shot counter 18 and/or a broadhead wrench 14.

These tools are all positioned on a web-like tool supporting body 10 which is incorporated into the bow riser in such a manner that neither it, nor the tools will interfere with the operation of the bow. The body is formed of a flat, rigid material and is approximately 1/16 to 1/8 of and inch in thickness.

The sharpener 12 ideally consists of two overlapping blades forming a v-shaped valley, suitable for sharpening a broadhead, which is a sharp implement consisting of one or more blades that is placed on the end of an arrow for hunting purposes. The sharpener may, however, also be used to sharpen a knife.

The broadhead wrench 14, which is formed from an impression imbedded in the body, can be used to tighten the broadhead onto the arrow, once it has been sharpened. This is accomplished by inserting the blades of the broadhead into the corresponding slots in the broadhead wrench.

The nock wrench 16, is also formed from an impression imbedded in the body and can be used to assist an archer in properly aligning the nock with the fletching. Similar to the broadhead wrench, this tool is utilized by inserting the nock components into the corresponding cut-outs forming the nock wrench on the body. Such a tool is particularly desirable to an archer, as manual alignment can often result in damage to the nock, which is quite often made out of plastic.

The shot counter 18 is also a very useful archery tool. It is important for an archer to know how many shots have been taken, so that he or she can determine when string replacement is required. The counter may be selected from a variety of conventional counters, and, for example, be configured so as to respond to the vibrations generated by the bow when an arrow is shot and display a number representative of the total number of shots taken in a sequence. Alternatively, it may respond to a mechanical strike or be an electronic device using a motion or light sensor.

Various Allen wrenches 20 may also optionally be incorporated into the riser 4 of the bow.

Figure 3:
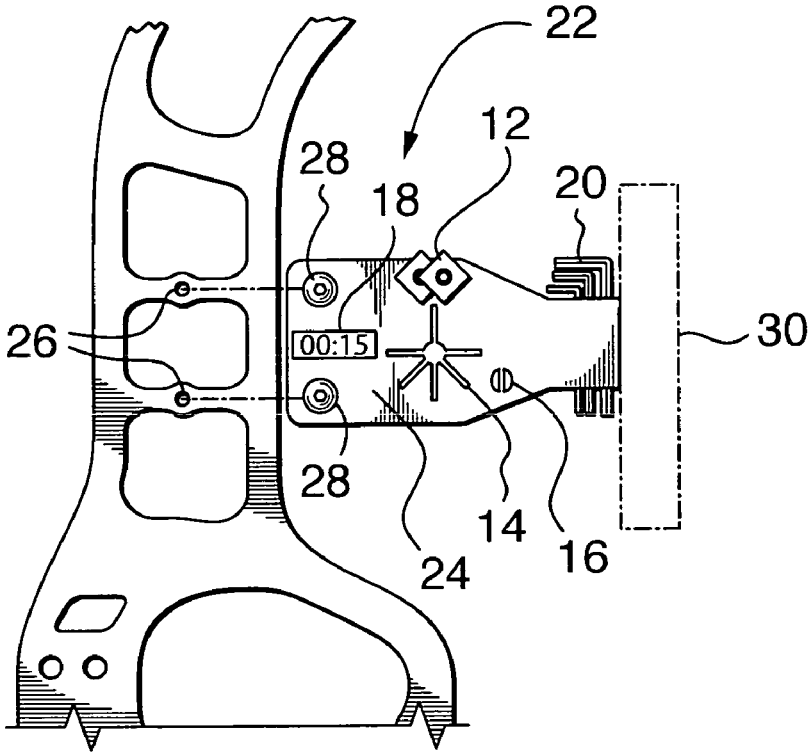
FIG. 3 is a side view of an alternative embodiment of the utility tool device according to the present invention.
Figure 4:
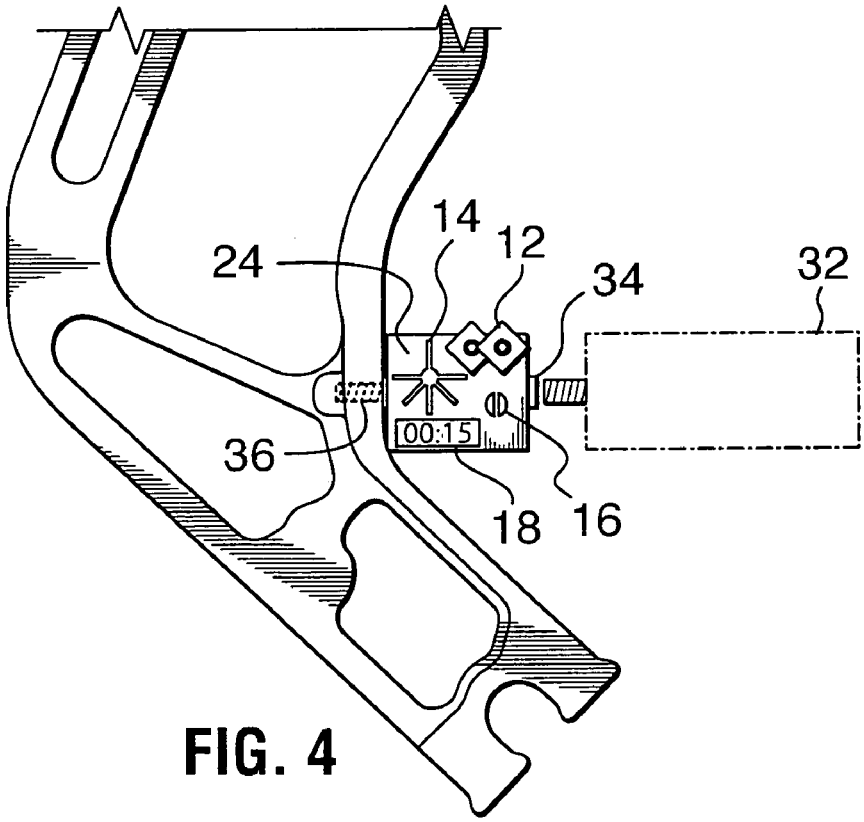
FIG. 4 is a side view of a further embodiment of the utility tool device according to the present invention.

Further embodiments of the present invention are shown in FIGS. 3 and 4. FIG. 3 shows the device 22 as an attachment. In addition to having a body 24 and two or more utility tools, the device also consists of apertures 26 to receive screws 28 through body 24 for securing it to the exterior of a bow riser 4. The device may include two or more utility tools selected from sharpener 12, shot counter 18, nock wrench 16, a broadhead wrench 14 and one or more individual Allen wrenches 20. The body 24 is equipped with at least one small hole extending side-ways therethrough, to receive and store the one or more Allen wrenches. This small hole(s) may be lined with a compression material for releasably securing the one or more wrenches.

As shown in FIG. 3, the device can be attached to a bow riser on the side opposite from the bow string by using pre-existing apertures 26 which are normally intended for use in attaching a sight 30. Instead of using these holes to attach a sight, the device 22 can be attached to the holes 26 by using attachment means such as screws 28. The sight can then be attached to the opposite end of the device as illustrated, if desired. Alternatively, it may be incorporated into part of the sight frame.

FIG. 4 shows a further embodiment of the present invention, wherein an attachment means such as a bolt 36 secures the body 24 to the bow riser on the side opposite from the bow string using a pre-existing hole which normally receives the stabilizer 32. The body is equipped with a receiving aperture 34, which permits the stabilizer to be attached thereto, rather than to the bow riser.

Thus, it is apparent that there has been provided in accordance with the present invention a device for transporting and storing archery tools and implements on an archery bow that fully satisfies the objects, aims and advantages set forth above. For example, while the device has been illustrated as being attached to the riser of the bow, it may be attached to any other part of the archery bow so long as it does not interfere with the operation of the bow. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

I claim:

1. An archery bow incorporating a utility tool device, the device comprising:

a body for carrying or supporting at least one tool; and at least one tool selected from the group consisting of:

a sharpener;

a shot counter;

a broadhead wrench; and a nock wrench, said tools being associated with the body and said body being formed as an integral component of a riser on the bow in an area where it will not interfere with the operation of the bow, wherein the sharpener comprises two overlapping blades forming a v-shaped valley for sharpening a broadhead or knife; and the body comprises a flat, rigid web-like tool supporting structure, said web-like structure further comprises multiple impressions configured to receive the respective at least one tool.

2. A device according to claim 1, wherein said riser includes an inner region and the body is positioned in said inner region of the riser.

3. A device according to claim 1, wherein the nock wrench is formed from an impression of said multiple impressions imbedded in the body.

4. A device according to claim 1, wherein the broadhead wrench is formed from an impression of said multiple impressions imbedded in the body.

5. A device according to claim 1, wherein the body has a thickness in the range of 1/16 to 1/8 of an inch.

6. A device according to claim 1, wherein at least one of said multiple impressions on said body is a hole configured to receive one of said respective tools.

7. An archery bow incorporating a utility tool device, the device comprising:

a body for carrying or supporting at least one tool; and at least one tool selected from the group consisting of:

a sharpener;

a shot counter;

a broadhead wrench; and a nock wrench, said tools being associated with the body and said body being formed as an integral component of a riser on the bow in an area where it will not interfere with the operation of the bow, further comprising at least one Allen wrench releasably securable to the riser of the bow in an area where said at least one Allen wrench will not interfere with the operation of the bow; and the body comprises a flat, rigid web-like tool supporting structure, said web-like structure further comprises multiple impressions configured to receive the respective at least one tool.

8. A device according to claim 7, wherein at least one of said multiple impressions on said body is a hole configured to receive one of said respective tools.

9. A utility tool device for an archery bow, the device comprising:

a body for carrying or supporting at least two tools;

at least two tools selected from the group consisting of:

a sharpener;

a counter;

a broadhead wrench;

a nock wrench; and at least one individual Allen wrench; and a device for securely but releasably attaching the body to a portion of the riser or any other part of the bow where said body will not interfere with the operation of the bow;

wherein the body comprises a flat, rigid plate-like tool supporting structure, said flat, rigid plate-like tool supporting structure further comprises multiple impressions configured to receive the respective at least two tools, and wherein the nock wrench is formed from an impression of said multiple impressions imbedded in the body.

10. A utility tool device for an archery bow, the device comprising:

a body for carrying or supporting at least two tools;

at least two tools selected from the group consisting of:

a sharpener;

a counter;

a broadhead wrench;

a nock wrench; and at least one individual Allen wrench; and a device for securely but releasably attaching the body to a portion of the riser or any other part of the bow where said body will not interfere with the operation of the bow;

wherein the body comprises a flat, rigid plate-like tool supporting structure, said flat, rigid plate-like tool supporting structure further comprises multiple impressions configured to receive the respective at least two tools, and wherein the broadhead wrench is formed from an impression of said multiple impressions imbedded in the body.

11. A utility tool device for an archery bow, the device comprising:

a body for carrying or supporting at least two tools;

at least two tools selected from the group consisting of:

a sharpener;

a counter;

a broadhead wrench;

a nock wrench; and at least one individual Allen wrench; and a device for securely but releasably attaching the body to a portion of the riser or any other part of the bow where said body will not interfere with the operation of the bow;

wherein the body comprises a flat, rigid plate-like tool supporting structure, said flat, rigid plate-like tool supporting structure further comprises multiple impressions configured to receive the respective at least two tools, and wherein the body further comprises at least one small hole extending sideways through said body to receive and store an individual Allen wrench, and wherein said at least one hole is lined with a compression fitting material for releasably holding an Allen wrench.

* * * * *